US006263655B1

(12) United States Patent
Artzt et al.

(10) Patent No.: US 6,263,655 B1
(45) Date of Patent: Jul. 24, 2001

(54) METHOD OF AND APPARATUS FOR THE BUNDLING OF SLIVER IN A DRAFTING FRAME OF A SPINNING MACHINE

(75) Inventors: Peter Artzt, Reutlingen; Jörg Morgner, Aichtal, both of (DE)

(73) Assignee: Zinser Textilmaschinen GmbH, Ebersbach/Fils (DE)

( * ) Notice: Subject to any disclaimer, the term of this patent is extended or adjusted under 35 U.S.C. 154(b) by 0 days.

(21) Appl. No.: 09/538,416

(22) Filed: Mar. 29, 2000

(30) Foreign Application Priority Data

Mar. 29, 1999 (DE) ..... 199 14 201

(51) Int. Cl.[7] ..... D01H 13/04

(52) U.S. Cl. ..... 57/315; 57/328; 19/150; 19/246

(58) Field of Search ..... 19/263, 286, 287, 19/288, 236–250, 252, 264, 150, 304–308, 257, 262; 57/315, 304, 264, 328, 333

(56) References Cited

U.S. PATENT DOCUMENTS 5,600,872 * 2/1997 Artzt et al. ..... 19/244
6,032,451 * 3/2000 Dinkelmann et al. ..... 57/315
6,073,314 * 6/2000 Barauke ..... 19/246
6,082,089 * 7/2000 Stahlecker ..... 57/315
6,134,872 * 10/2000 Olbrich ..... 57/264

FOREIGN PATENT DOCUMENTS 43 23 427 1/1995 (DE) .
196 23 824 10/1997 (DE) .
197 22 528 9/1998 (DE) .
198 46 268 10/1999 (DE) .

* cited by examiner

*Primary Examiner*—John J. Calvert
*Assistant Examiner*—Gary L. Welch
(74) *Attorney, Agent, or Firm*—Herbert Dubno

(57) ABSTRACT

Method of and apparatus for bundling fibers of a sliver in the drafting frame of a spinning machine in which a fiber-bundling zone is provided downstream of the last pair of drafting rollers. The fiber-bundling zone can be formed with a transporter for the sliver, e.g. a belt, provided with an array of perforations having a width which is at least equal to the traversing width of the sliver. The suction orifice juxtaposed with the array of perforations of the belt is inclined to the direction of the travel of the sliver and preferably extends over the full width of the traversing motion. The edge of the orifice can be rectilinear or curved.

9 Claims, 3 Drawing Sheets

METHOD OF AND APPARATUS FOR THE BUNDLING OF SLIVER IN A DRAFTING FRAME OF A SPINNING MACHINE

FIELD OF THE INVENTION

Our present invention relates to a method of and to an apparatus for the bundling of the fibers of sliver in a drafting frame of a spinning machine and, in particular, between the output pair of rollers of the drafting frame and the twist-imparting system of the spinning machine. The invention, therefore, relates to a method of making a thread using a drafting frame of a spinning machine and to a method of operating a spinning machine and/or drafting frame to make a thread.

BACKGROUND OF THE INVENTION

The term "sliver" is here used to refer to the fiber band or strip which generally may be drawn from a "can", is drafted in a drafting frame and is then subjected to a twisting operation in, for example, a ring-spinning station. The drafting frame can be provided all along a ring-spinning frame and, at each ring-spinning station, the sliver is fed to the spinning mechanism through a plurality of pairs of rollers of the drafting frame, emerging at the output pair of rollers.

The fiber band or strip is referred to here as sliver, and can also be referred to as roving, the difference between a roving and a sliver generally being the fact that the roving has a slight twist previously imparted to the fiber band or strip before it enters the drafting frame. The present invention is applicable to roving as well and the term "sliver" as here used is intended to apply to fiber bands or strips which are collections of individual fibers of limited length.

Such fiber bands may be subjected to a bundling between the drafting frame and the twist-imparting mechanism. The purpose of such bundling is to make the strand consisting of a multiplicity of fibers, more compact at the inception of twisting. Fibers which project out of the strand or in directions transverse or at an angle to the main direction of the strand are usually drawn back into the body of the strand by such compaction.

In the so-called double-belt drafting frame of DE 43 23 472 C2, a bundling of the strand is described in which the sliver leaving the output roller pair of the drafting frame is subjected to a suction stream which is applied transversely to the travel direction of the strand over a length of a fiber bundling zone. The strand passes over a row of perforations subjected to suction for this purpose. The size of the perforations determines the width of the bundles and compacted roving.

To reduce the wear of the pressure roller in this latter drafting frame, it is customary to induce an offset of the roving from side to side as it is introduced into the drafting frame. This back and forth motion of the roving is referred to here as a traversing motion, and causes the strand to move back and forth during its passage through the drafting frame transversely to the travel direction. When a suction compaction of the prior art type is applied, this traversing motion must be excluded or means must be provided to enable the row of suction bores to remain effective in spite of the traversing motion. In practice, this can be achieved by guidance of the strand with a funnel-shaped guide or by limiting the traversing motion or by conceding a lack of ability to effectively bundle the strand.

In the double-belt drafting frame of DE 197 22 528, the fiber-bundling zone is provided downstream of the output roller pair of the main drafting region. In this case, a transport means, for example a belt, is provided with the suction perforations which are enlarged in a direction transverse to the transport direction. Thereafter, the strand is subjected to suction from a series of finer perforations.

While this system represents an improvement over earlier arrangements, it is also a compromise because the sizes of the larger and smaller perforations are nevertheless limited with respect to the potential traversing motion and the possible stroke of the traversing action and this system as well limits the traversing width or stroke in the sense previously described.

A spinning machine has also been described (see DE 196 23 824 A1) in which a convergence is generated in the suction zone between two strands. A disadvantage in this system is that it is not possible to exclude an effect of suction from one row of perforations on the other strand which might tend to defeat the compaction effect.

OBJECTS OF THE INVENTION

It is, therefore, the principal object of the present invention to provide an improved method of making a thread utilizing a drafting frame of a spinning machine with fiber bundling in a suction zone downstream of the last pair of drafting rollers whereby the sliver or roving can be optimally compacted or the fibers thereof bundled, without limitation of the traversing motion.

Another object of the invention is to provide a method of operating a spinning machine whereby drawbacks of earlier systems are obviated.

Still another object is to provide a drafting frame and spinning machine combination which has optimum suction bundling of the fiber strand, e.g. the sliver or roving, without restriction on the traversing motion.

SUMMARY OF THE INVENTION

These objects and others which will become apparent hereinafter are attained, in accordance with the invention, in a method of making a thread using a drafting frame of a spinning machine which comprises the steps of:

(a) drafting a sliver with the drafting frame by passing the sliver through a succession of drafting roller pairs to emerge at an output roller pair, the sliver emerging from the output roller pair having a traversing motion back and forth transverse to a direction of feed of the sliver;

(b) bundling fibers of the sliver by contacting the sliver immediately downstream of the output roller pair on only one side of the sliver with a generally flat portion of a belt moving with the sliver in the direction over a length of a bundling zone, the belt having a surface on one side of the belt in contact with the sliver and being formed with a multiplicity of perforations open toward the sliver in an array extending over the length and of a width at least equal to a stroke of the traversing motion, and applying suction to the array of perforations with an elongated suction orifice juxtaposed with an opposite side of the belt, inclined to the direction and shaped so that the suction is applied to the sliver transversely of the direction to draw fibers of the sliver together and bundle the fibers of the sliver over the entire width of the array; and (c) twisting the sliver following the bundling thereof downstream of the belt into a single thread.

The apparatus of the invention can comprise:

a drafting frame having a succession of drafting roller pairs for drafting a sliver by passing the sliver through the succession of drafting roller pairs to emerge at an output roller pair, the sliver emerging from the output roller pair having a traversing motion back and forth transverse to a direction of feed of the sliver;

means for bundling fibers of the sliver immediately downstream of the output roller pair and including a transport belt contacting the sliver immediately downstream of the output roller pair on only one side of the sliver with a generally flat portion of the belt moving with the sliver in the direction over a length of a bundling zone, the belt having a surface on one side of the belt in contact with the sliver and being formed with a multiplicity of perforations open toward the sliver in an array extending over the length and of a width at least equal to a stroke of the traversing motion, and suction means applying suction to the array of perforations with an elongated suction orifice juxtaposed with an opposite side of the belt, inclined to the direction and shaped so that the suction is applied to the sliver transversely of the direction to draw fibers of the sliver together and bundle the fibers of the sliver over the entire width of the array; and means downstream of the belt for twisting the sliver following the bundling thereof into a single thread.

The objects of the invention, therefore, are achieved in that in the process the fibers of the fiber-band sliver or roving) are drawn together (i.e. collected or compacted) at least in part by a suction action resulting from movement of the roving or sliver past an edge of an elongated suction opening which is at least partly inclined to the transport direction.

According to a feature of the invention, the output pair of rollers and the belt are spaced and coordinated to operate with an oversupply or undersupply of the sliver depending upon fiber elongation and fiber length, as will be detailed above with the oversupply or undersupply being in the range of ±5%.

The edge of the orifice which is inclined to the travel direction of the sliver can be arcuate and arrow-shaped or rectilinear and arrow-shaped and the orifice can extend over the entire width of the array or over only part of the width of the array.

Means can be provided for varying a ratio of peripheral speeds of the output pair of rollers and the belt.

The invention represents an advance on yarn-compacting systems using suction and having, for example, a suction shoe connected to a suction source and communicating with a row of perforations of a belt forming a transport means for the strand. In such cases, the belt normally comprises a single row of such perforations. These perforations must be wide enough to cover the traversing stroke of the strand.

By contrast, the invention provides an array of perforations over a width of the belt sufficient to allow for a large traversing range and a suction opening of a shoe communicating with the openings of that array over at least a major portion of the width thereof and oriented at least partly with an inclination to the transport direction. As soon as the fibers of the uncompacted fiber band or sliver encounter the suction flow, the combination of that suction through the perforations of the belt and the travel of the strand across the edge of the suction opening or nozzle induce a compaction of the fibers toward one another and hence the bundling of the strand.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
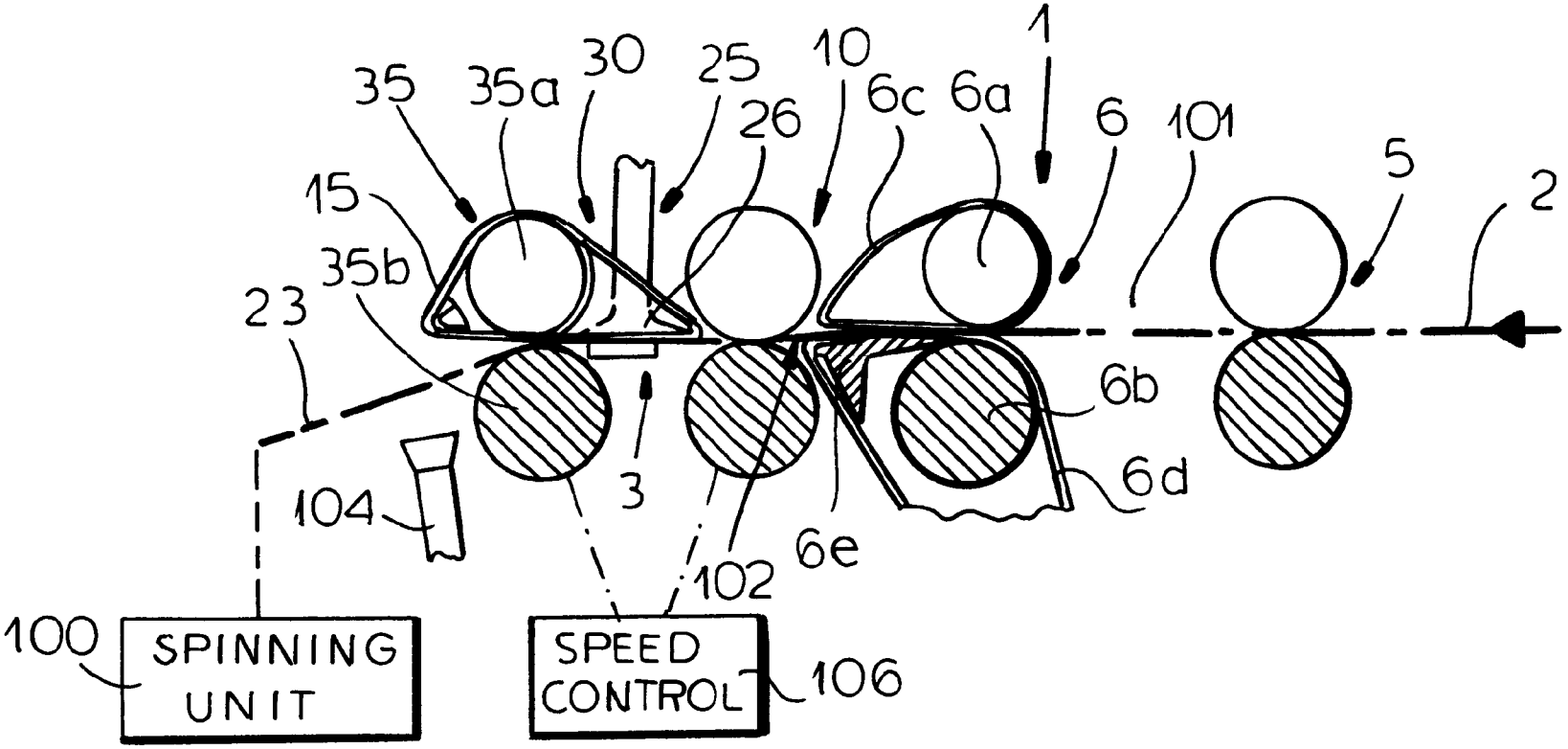
FIG. 1 is a side elevational view, partly in section, showing a double-belt drafting frame with an inlet roller pair, a main drafting zone, a compaction device and a supply device feeding the compacted sliver to a spinning unit.
Figure 2:
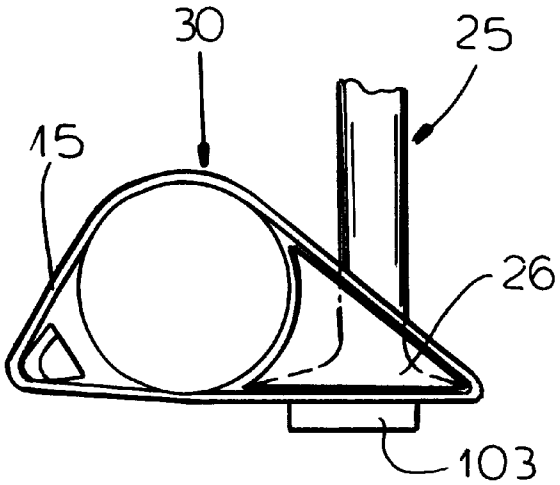
FIG. 2 is a detail enlarged in scale of the compaction device showing the suction shoe, its connection to the suction pump and its relationship to the belt in a schematic side-elevational view.
Figure 3:
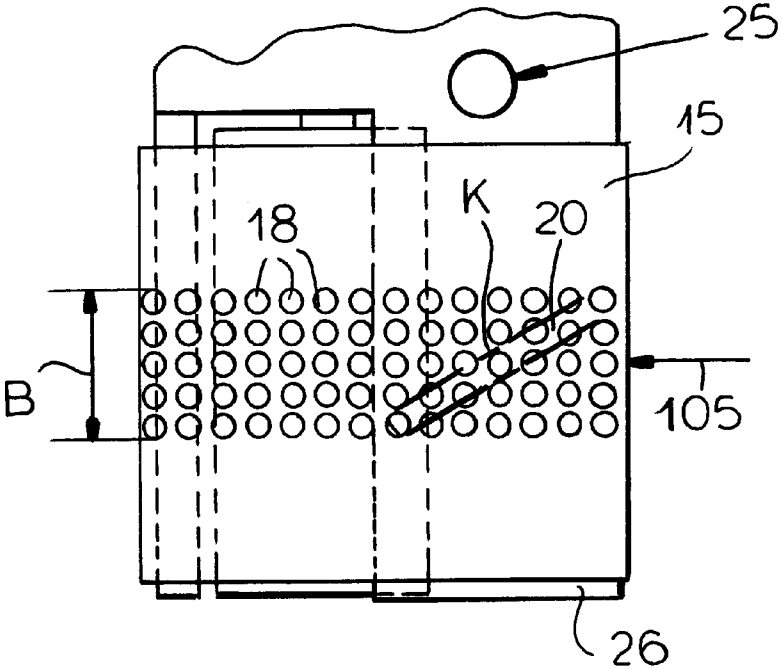
FIG. 3 is a diagrammatic bottom plan view of the device of FIG. 2.
Figures 4A, 4B, 4C, 4D, 4E:
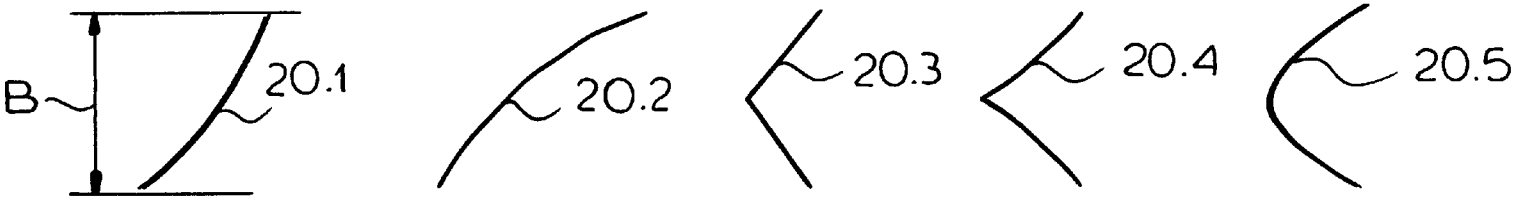
FIGS. 4*a*–4*e* are views showing various possible shapes of the edge of the suction opening in diagrammatic plan view.

FIGS. 1–3 show a drafting frame 1 for a spinning machine which includes that drafting frame and a spinning unit 100, preferably a ring-spinning unit, having a multiplicity of stations and spindles arrayed along the drafting frame perpendicular to the plane of the paper in FIG. 1 and each receiving a strand from the drafting frame and twisting that strand while winding the twisted strand in a bobbin or cop.

The strand delivered by the drafting frame is compacted in spite of the fact that it has a traversing motion, i.e. motion back and forth in the plane of the strand and perpendicular to the plane of the paper in FIG. 1 and parallel to the plane of the paper in the view of FIG. 3.

The drafting frame comprises a first roller pair 5 and a second roller pair 6 receiving the sliver 2. The rollers 6*a* and 6*b* of each are engaged by belts 6*c* and 6*d* which can be guided over bars 6*e* as is conventional in the drafting-frame field. The essential drafting region has been shown at 101 in FIG. 1 between the roller pairs 5 and 6 which operate respectively at a slower peripheral speed and faster peripheral speed. The main drafting region has been shown at 102 between the roller pair 6 and an output roller pair 10 which also operates at different peripheral speeds, the peripheral speed of the output roller pair 10 being greater than that of the input roller pair.

Downstream of the output roller pair 10 a pneumatic compaction unit 30 is provided which includes a feed device 35 delivering the compacted sliver 23 to the spinning unit. The region between the output roller pair 10 and the delivery unit 35 forms a so-called fiber bundling zone 3. In this zone the sliver leaving the output roller pair 10 is subjected to a suction airstream transverse to its length over a corresponding length of the fiber bundling zone to draw the fibers into the strand and compact the strand in spite of the traversing movement thereof.

The fiber bundling zone is formed with a transport belt 15 (see also FIGS. 2 and 3) provided with a wide array of perforations 18 cooperating with the suction shoe 26 connected by fitting 25 to a suction source. The suction shoe rides against the side of the belt turned away from the strand. A support 103 can be provided beneath the band. The belt 15 passes over the upper roller 35*a* of the delivery device 35 which is juxtaposed with a lower roller 35*b*. Particulates and fluff can be pulled off by a suction pipe 104 (FIG. 1).

As can be seen from FIG. 2, the suction device 25 with its shoe 26 extends over the perforated region of the belt 15, i.e. the transport device.

FIG. 3 shows that the suction orifice 20 of the shoe 26 is inclined to the travel direction (arrow 105) and has at least one edge K which is inclined to this direction. The width of the array of holes or perforations 18 is represented at B and the traversing movement of the strand across the belt can be considered to have a stroke which is equal to or less than the value B. As the strand passes the edges K of the orifice 20, the suction flow draws the fibers of the sliver toward the body thereof and thereby compacts the sliver.

The orifice 20 is inclined and preferably extends over the full width B of the array of perforations. It is, however, also possible to so incline the suction opening that the edge K is only provided at edge regions of the perforation array. In either case, the sliver is compacted without limitation of the traversing width.

FIGS. 4*a*–4*e* show other configurations of the edges K, for example, the edges can be concave and curved as shown at 20.1, convex and curved as shown at 20.2, can be rectilinear and arrow-shaped as shown at 20.3, can be curved and arrow-shaped as shown at 20.4 and 20.5. In all of these cases, fibers will be urged together in the band and the band or sliver compacted.

The apparatus can, in addition, have a speed control which can be coupled between the output pair of rolls 10 and the rolls 35*a,* 35*b,* the speed control being represented at 106 in FIG. 1.

With the invention, optimal compaction of sliver can be effected in the fiber-bundling zone 3 without limitation of the traversing width which is advantageous as has previously been described. The lateral shifting of the sliver, i.e. traversing action, varies the distance over which the sliver extends between the nips at the drafting frame output and the delivery device at the end of the compaction zone. This can be compensated by the speed control 106 which can provide a variation in the speed ratio from the drafting frame output to the delivery device. Depending upon fiber elongation and fiber length, the oversupply or undersupply of the sliver in a range of ±5% is provided. This is especially important in the processing of sliver according to the invention when the individual fiber ranges of the sliver are greater than the distance between the nips.

We claim:

1. A method of making a thread using a drafting frame of a spinning machine, comprising the steps of:

(a) drafting a sliver with said drafting frame by passing the sliver through a succession of drafting roller pairs to emerge at an output roller pair, the sliver emerging from said output roller pair having a traversing motion back and forth transverse to a direction of feed of the sliver;

(b) bundling fibers of the sliver by contacting the sliver immediately downstream of said output roller pair on only one side of the sliver with a generally flat portion of a belt moving with said sliver in said direction over a length of a bundling zone, said belt having a surface on one side of said belt in contact with said sliver and being formed with a multiplicity of perforations open toward the sliver in an array extending over said length and of a width at least equal to a stroke of said traversing motion, and applying suction to said array of perforations with an elongated suction orifice juxtaposed with an opposite side of said belt, inclined to said direction and shaped so that the suction is applied to said sliver transversely of said direction to draw fibers of the sliver together and bundle the fibers of the sliver over the entire width of said array; and (c) twisting the sliver following the bundling thereof downstream of said belt into a single thread, said output pair of rollers and said belt being spaced and coordinated to operate with an oversupply or undersupply of the sliver depending upon fiber elongation and fiber length.

2. A method of making a thread using a drafting frame of a spinning machine, comprising the steps of:

(a) drafting a sliver with said drafting frame by passing the sliver through a succession of drafting roller pairs to emerge at an output roller pair, the sliver emerging from said output roller pair having a traversing motion back and forth transverse to a direction of feed of the sliver;

(b) bundling fibers of the sliver by contacting the sliver immediately downstream of said output roller pair on only one side of the sliver with a generally flat portion of a belt moving with said sliver in said direction over a length of a bundling zone, said belt having a surface on one side of said belt in contact with said sliver and being formed with a multiplicity of perforations open toward the sliver in an array extending over said length and of a width at least equal to a stroke of said traversing motion, and applying suction to said array of perforations with an elongated suction orifice juxtaposed with an opposite side of said belt, inclined to said direction and shaped so that the suction is applied to said sliver transversely of said direction to draw fibers of the sliver together and bundle the fibers of the sliver over the entire width of said array; and (c) twisting the sliver following the bundling thereof downstream of said belt into a single thread, said output pair of rollers and said belt being spaced and coordinated to operate with an oversupply or undersupply of the sliver depending upon fiber elongation and fiber length is in the range of ±5%.

3. An apparatus for making a thread, comprising:

a drafting frame having a succession of drafting roller pairs for drafting a sliver by passing the sliver through the succession of drafting roller pairs to emerge at an output roller pair, the sliver emerging from said output roller pair having a traversing motion back and forth transverse to a direction of feed of the sliver;

means for bundling fibers of the sliver immediately downstream of said output roller pair and including a transport belt contacting the sliver immediately downstream of said output roller pair on only one side of the sliver with a generally flat portion of said belt moving with said sliver in said direction over a length of a bundling zone, said belt having a surface on one side of said belt in contact with said sliver and being formed with a multiplicity of perforations open toward the sliver in an array extending over said length and of a width at least equal to a stroke of said traversing motion, and suction means applying suction to said array of perforations with an elongated suction orifice juxtaposed with an opposite side of said belt, inclined to said direction and shaped so that the suction is applied to said sliver transversely of said direction to draw fibers of the sliver together and bundle the fibers of the sliver over the entire width of said array;

means downstream of said belt for twisting the sliver following the bundling thereof into a single thread; and means for varying a ratio of peripheral speeds of said output pair of rollers and said belt.

4. The apparatus defined in claim 3 wherein said orifice has at least one edge inclined to said direction.

5. The apparatus defined in claim 3 wherein said edge is arcuate.

6. The apparatus defined in claim 3 wherein said edge is arrow-shaped.

7. The apparatus defined in claim 3 wherein said orifice extends over the entire width of said array.

8. An apparatus for making a thread, comprising:

a drafting frame having a succession of drafting roller pairs for drafting a sliver by passing the sliver through the succession of drafting roller pairs to emerge at an output roller pair, the sliver emerging from said output roller pair having a traversing motion back and forth transverse to a direction of feed of the sliver;

means for bundling fibers of the sliver immediately downstream of said output roller pair and including a transport belt contacting the sliver immediately downstream of said output roller pair on only one side of the sliver with a generally flat portion of said belt moving with said sliver in said direction over a length of a bundling zone, said belt having a surface on one side of said belt in contact with said sliver and being formed with a multiplicity of perforations open toward the sliver in an array extending over said length and of a width at least equal to a stroke of said traversing motion, and suction means applying suction to said array of perforations with an elongated suction orifice juxtaposed with an opposite side of said belt, inclined to said direction and shaped so that the suction is applied to said sliver transversely of said direction to draw fibers of the sliver together and bundle the fibers of the sliver over the entire width of said array; and means downstream of said belt for twisting the sliver following the bundling thereof into a single thread, said output pair of rollers and said belt are spaced and coordinated to operate with an oversupply or undersupply of the sliver depending upon fiber elongation and fiber length.

9. An apparatus for making a thread, comprising:

a drafting frame having a succession of drafting roller pairs for drafting a sliver by passing the sliver through the succession of drafting roller pairs to emerge at an output roller pair, the sliver emerging from said output roller pair having a traversing motion back and forth transverse to a direction of feed of the sliver;

means for bundling fibers of the sliver immediately downstream of said output roller pair and including a transport belt contacting the sliver immediately downstream of said output roller pair on only one side of the sliver with a generally flat portion of said belt moving with said sliver in said direction over a length of a bundling zone, said belt having a surface on one side of said belt in contact with said sliver and being formed with a multiplicity of perforations open toward the sliver in an array extending over said length and of a width at least equal to a stroke of said traversing motion, and suction means applying suction to said array of perforations with an elongated suction orifice juxtaposed with an opposite side of said belt, inclined to said direction and shaped so that the suction is applied to said sliver transversely of said direction to draw fibers of the sliver together and bundle the fibers of the sliver over the entire width of said array; and means downstream of said belt for twisting the sliver following the bundling thereof into a single thread, said output pair of rollers and said belt are spaced and coordinated to operate with an oversupply or undersupply of the sliver depending upon fiber elongation and fiber length in the range of ±5%.

* * * * *